US010946661B2

(12) United States Patent
Tsuji et al.

(10) Patent No.: US 10,946,661 B2
(45) Date of Patent: Mar. 16, 2021

(54) INK JET RECORDING METHOD AND INK JET RECORDING APPARATUS

(71) Applicant: CANON KABUSHIKI KAISHA, Tokyo (JP)

(72) Inventors: Shinsuke Tsuji, Kawasaki (JP); Atsuhito Yoshizawa, Tokyo (JP); Arihiro Saito, Saitama (JP); Takashi Saito, Zushi (JP); Ryota Takeuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/592,298

(22) Filed: Oct. 3, 2019

(65) Prior Publication Data

US 2020/0108613 A1 Apr. 9, 2020

(30) Foreign Application Priority Data

Oct. 4, 2018 (JP) ..... JP2018-189021

(51) Int. Cl.
*B41J 2/165* (2006.01)

(52) U.S. Cl.
CPC ..... *B41J 2/16535* (2013.01); *B41J 2/16585* (2013.01); *B41J 2002/16573* (2013.01)

(58) Field of Classification Search
CPC ..... B41J 2/16535; B41J 2/16585; B41J 2002/16573
See application file for complete search history.

(56) References Cited

U.S. PATENT DOCUMENTS

| | | | | |
|---|---|---|---|---|
| 2008/0174631 | A1 | 7/2008 | Habashi | |
| 2012/0299996 | A1 | 11/2012 | Kano et al. | |
| 2017/0173962 | A1* | 6/2017 | Mizuno | B41J 2/16523 |
| 2020/0086647 | A1* | 3/2020 | Mizuno | B41J 2/14 |

FOREIGN PATENT DOCUMENTS

| | | | |
|---|---|---|---|
| JP | 2008179056 | A | 8/2008 |
| JP | 2012166374 | A | 9/2012 |
| JP | 2017124636 | A | 7/2017 |

* cited by examiner

*Primary Examiner* — Julian D Huffman
(74) *Attorney, Agent, or Firm* — Venable LLP

(57) ABSTRACT

A method of forming an image on a recording medium using an ink jet recording apparatus. The ink jet recording apparatus includes a recording head in which a plurality of recording element substrates is arranged to form joint portions and a plurality of wipers is arranged to form wiper overlapping portions. The method includes ejecting a first ink from a first ejection orifice array, ejecting a second ink from a second ejection orifice array, and the plurality of recording element substrates with the plurality of wipers. The first ejection orifice array is wiped and then the second ejection orifice array is wiped. At least a part of the wiper overlapping portion wipes the joint portion. A dynamic surface tension ($\gamma_{D1}$) of the first ink is equal to or more than a static surface tension ($\gamma_{S2}$) of the second ink.

17 Claims, 5 Drawing Sheets

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

In recent years, an ink jet recording apparatus has been increasingly used in offices or the commercial printing field. In addition, further increasing a recording speed and an optical density of an image to be recorded has been required in the ink jet recording apparatus. In order to increase the recording speed, a method of recording an image by using a line type recording head (line head), that is, a one pass recording method, is more advantageous than a multi-pass recording method in which a serial type recording head (serial head) is used.

In general, cleaning of a recording head is performed in order to maintain a good ejection state of ink from an ejection orifice of the recording head. For example, cleaning methods in which a wiper is brought in contact with a surface (ejection orifice surface) on which an ejection orifice array of a recording head, which eject ink, are formed to wipe the ejection orifice surface have been proposed (Japanese Patent Application Laid-Open No. 2017-124636, Japanese Patent Application Laid-Open No. 2012-166374 and Japanese Patent Application Laid-Open No. 2008-179056).

However, when cleaning the head line by the cleaning methods proposed in Japanese Patent Application Laid-Open No. 2017-124636 and Japanese Patent Application Laid-Open No. 2012-166374, ends of adjacent recording element substrates overlap, that is, a contact force of the wiper tends to be insufficient at a location where a narrow gap or step such as "a joint portion" is present. Therefore, it is difficult to sufficiently recover the ejection state of the recording head. In order to solve the above problems, the inventors of the present invention conducted further studies. As a result, as proposed in Japanese Patent Application Laid-Open No. 2008-179056, it was found that it is efficient to perform wiping by a wiper configured by arranging a plurality of blade wipers so that ends of the adjacent wipers overlap each other to form overlapping portions.

The inventors of the present invention conducted studies on an image recorded by a recording method to which a cleaning method by the above wiping is applied. As a result, it was appreciated that density unevenness caused by an optical density difference is likely to occur.

An object of the present invention is to provide an ink jet recording method capable of suppressing density unevenness and an irregular ejection at a location corresponding to a joint portion of adjacent recording element substrates and recording an image having a high quality. Another object of the present invention is to provide an ink jet recording apparatus using the ink jet recording method.

SUMMARY OF THE INVENTION

The above objects are achieved by the following invention. According to the present invention, there is provided a method of forming an image on a recording medium using an ink jet recording apparatus. The ink jet recording apparatus including a recording head having a plurality of recording element substrates arranged in an arrangement direction so that ends of the adjacent recording element substrates overlap each other in the predetermined direction to form joint portions. Each recording element substrate includes a plurality of ejection orifice arrays. The method includes ejecting a first ink from ejection orifices of a first ejection orifice array, ejecting a second ink from ejection orifices of a second ejection orifice array, and wiping the ejection orifice surfaces of the plurality of recording element substrates with a plurality of blade wipers. The first ejection orifice array is one of the plurality of ejection orifice arrays of each recording element substrate. The ejection orifices of the first ejection orifice array are arranged in the arrangement direction and formed on an ejection orifice surface of each recording element substrate. The second ejection orifice array is one of the plurality of ejection orifice arrays of each recording element substrate. The ejection orifices of the second ejection orifice array are arranged in the arrangement direction and formed on the ejection orifice surface of each recording element substrate. The plurality of blade wipers are arranged in the arrangement direction so that ends of the adjacent wipers overlap each other in the arrangement direction to form wiper overlapping portions. The plurality of wipers are brought into contact with the ejection orifice surfaces in a direction intersecting the arrangement direction of the recording element substrates to first wipe the first ejection orifice array and then wipe the second ejection orifice array. At least a part of the wiper overlapping portion wiping the joint portion. A dynamic surface tension ($\gamma_{D1}$) of the first ink is equal to or more than a static surface tension ($\beta_{S2}$) of the second ink.

According to the present invention, it is possible to provide the ink jet recording method capable of suppressing density unevenness and an irregular ejection at a location corresponding to a joint portion of adjacent recording element substrates and recording an image having a high quality. In addition, according to the present invention, it is possible to provide the ink jet recording apparatus using the ink jet recording method.

Further features of the present invention will become apparent from the following description of exemplary embodiments with reference to the attached drawings.

DESCRIPTION OF THE EMBODIMENTS

Hereinafter, the present invention is described in more detail with reference to the preferred embodiments. In the present invention, in a case where a compound is a salt, the salt is dissociated into ions and is present in ink, but for the convenience, the expression "contains a salt" is used. In addition, aqueous ink for ink jet is simply referred to as "ink". Values of physical properties are, but not particularly limited to, values at normal temperature (25° C.).

<Ink Jet Recording Method>

Figure 2:
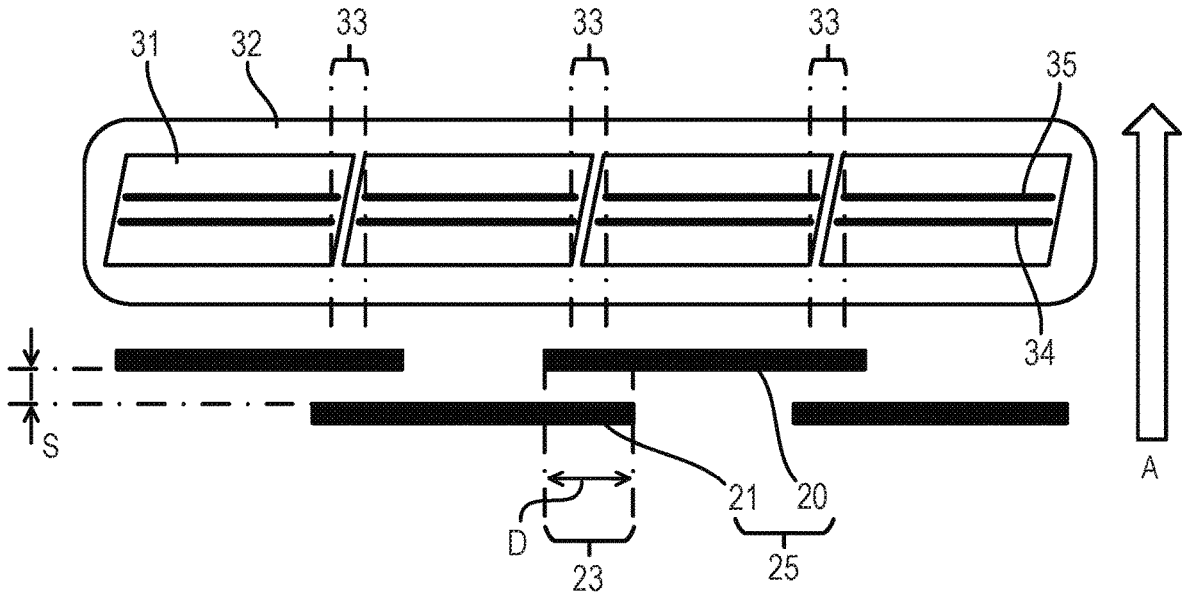
FIG. 2 is a schematic view illustrating an example of a recording head and a cleaning unit constituting the ink jet recording apparatus of the present invention.

FIG. 2 is a schematic view illustrating an example of a recording head and a cleaning unit for an ink jet recording apparatus. The ink jet recording method of the present invention is a method of recording an image on a recording medium using an ink jet recording apparatus including a recording head 32 and a cleaning unit 25, as illustrated in FIG. 2. The recording head 32 includes a plurality of recording element substrates 31 having ejection orifice arrays (a first ejection orifice array 34 and a second ejection orifice array 35) in which a plurality of ejection orifices are arranged in a predetermined direction. The ejection orifices eject aqueous ink containing a pigment. The plurality of recording element substrates 31 are arranged in the predetermined direction so that ends of the adjacent recording element substrates overlap each other in the predetermined direction to form joint portions 33. That is, the joint portion is formed by overlapping only ends of the recording element substrates. In addition, the cleaning unit 25 includes a plurality of blade wipers (a first wiper 20 and a second wiper 21). The first wiper 20 and the second wiper 21 are arranged in a predetermined direction so that ends of the adjacent wipers overlap each other in a predetermined direction to form wiper overlapping portions 23. That is, the wiper overlapping portions are formed by overlapping only ends of the respective wipers. The cleaning unit 25 is a unit performing wiping by bringing the first wiper 20 and the second wiper 21 into contact with the first ejection orifice array 34 and the second ejection orifice array 35 in a direction intersecting an arrangement direction of the recording element substrate 31 (in FIG. 2, a direction indicated by arrow A). In addition, at least a part of the wiper overlapping portion 23 wipes the joint portion 33.

The inventors of the present invention studied the quality of the image recorded by using the ink jet recording apparatus including the recording head and the cleaning unit as described above. As a result, it was found that density unevenness on the recorded image caused by an optical density difference is likely to occur at a location corresponding to the joint portion of the recording head or a location corresponding to the wiper overlapping portion of the cleaning unit. After conducting further studies, it was determined that the following phenomenon occurred at a location subjected to wiping by the wiper overlapping portion 23.

When the first ejection orifice array 34 is wiped by, among the wipers forming the wiper overlapping portion 23, the first wiper 20 positioned in the front side of a wiping direction, ink in an ink flow path is drawn from the ejection orifice in contact with the first wiper 20 to a surface of the first ejection orifice array 34. In addition, the drawn ink flows into an ink flow path, by the second wiper 21 positioned in the rear side of the wiping direction, from the ejection orifice of the second ejection orifice array 35 positioned downstream of the first ejection orifice array 34 and the ink is mixed with ink in the ink flow path. Furthermore, such an ink mixing phenomenon is likely to significantly occur at the joint portion 33 having steps. That is, the mixing phenomenon is most likely to occur at the joint portion wiped by the wiper overlapping portion and is next most likely to occur at locations other than the joint portions wiped by the wiper overlapping portions. However, the mixing phenomenon that affects the image almost does not occur at locations wiped by portions other than the wiper overlapping portion.

Accordingly, a mixing state of ink in the ink flow path is different at each ejection orifice and a difference in physical properties of ink present near the ejection orifice of the ink flow path is generated. It is considered that when the image (in particular, a solid image) is recorded in such a state, since the amount of ink ejected from each ejection orifice is not uniform, the density unevenness caused by the optical density difference occurs. Furthermore, in a case where the image is recorded by an ink jet recording apparatus in which recording element substrates are arranged inline with each other, that is, a so-called in-line type full multi-head is included, the density unevenness caused by the mixing phenomenon is likely to occur. It is considered that, in the in-line type full multi-head, since the ejection orifices are present near the joint portion, the mixing phenomenon is more likely to occur.

Under these circumstances, the inventor of present inventors conducted further studies and found that a relationship between a dynamic surface tension of ink drawn by the first wiper and a static surface tension of ink in the ink flow path through which the drawn ink flows has a strong correlation with the mixing phenomenon. In addition, it was found that when a dynamic surface tension ($\gamma_{D1}$) of a first ink ejected from the first ejection orifice array is equal to or more than a static surface tension ($\gamma_{S2}$) of a second ink ejected from the second ejection orifice array, the occurrence of the mixing phenomenon is suppressed and the density unevenness can be reduced.

In the ink jet recording method of the present invention, a plurality of ejection orifice arrays include the first ejection orifice array ejecting the first ink and the second ejection orifice array ejecting the second ink, and the cleaning unit sequentially wipes the first ejection orifice array and the second ejection orifice array. The dynamic surface tension ($\gamma_{D1}$) of the first ink is the static surface tension ($\gamma_{S2}$) of the second ink or more. When the dynamic surface tension ($\gamma_{D1}$) of the first ink is less than the static surface tension ($\gamma_{S2}$) of the second ink, the first ink drawn from the first ejection orifice array flows to the second ejection orifice array and is likely to be mixed with the second ink. In the present specification, a "dynamic surface tension ($\gamma_D$)" is a "dynamic surface tension ($\gamma_D$) at a lifetime of 10 milliseconds" measured by a maximum bubble pressure method.

(Ink Jet Recording Apparatus)

The ink jet recording apparatus used in the ink jet recording method of the present invention includes the recording head 32 and the cleaning unit 25 configured as illustrated in FIG. 2. It is preferable that the ink jet recording apparatus further includes a second cleaning unit sucking and cleaning the ejection orifice surface separately from the cleaning unit described above. By using the ink jet recording apparatus further including the second cleaning unit sucking and cleaning the ejection orifice surface, the image having a higher quality can be recorded. An example of the second cleaning unit may include a wiper unit having a suction nozzle sucking and cleaning an ejection orifice surface, which is disclosed in Japanese Patent Application Laid-Open No. 2012-166374.

Figure 1:
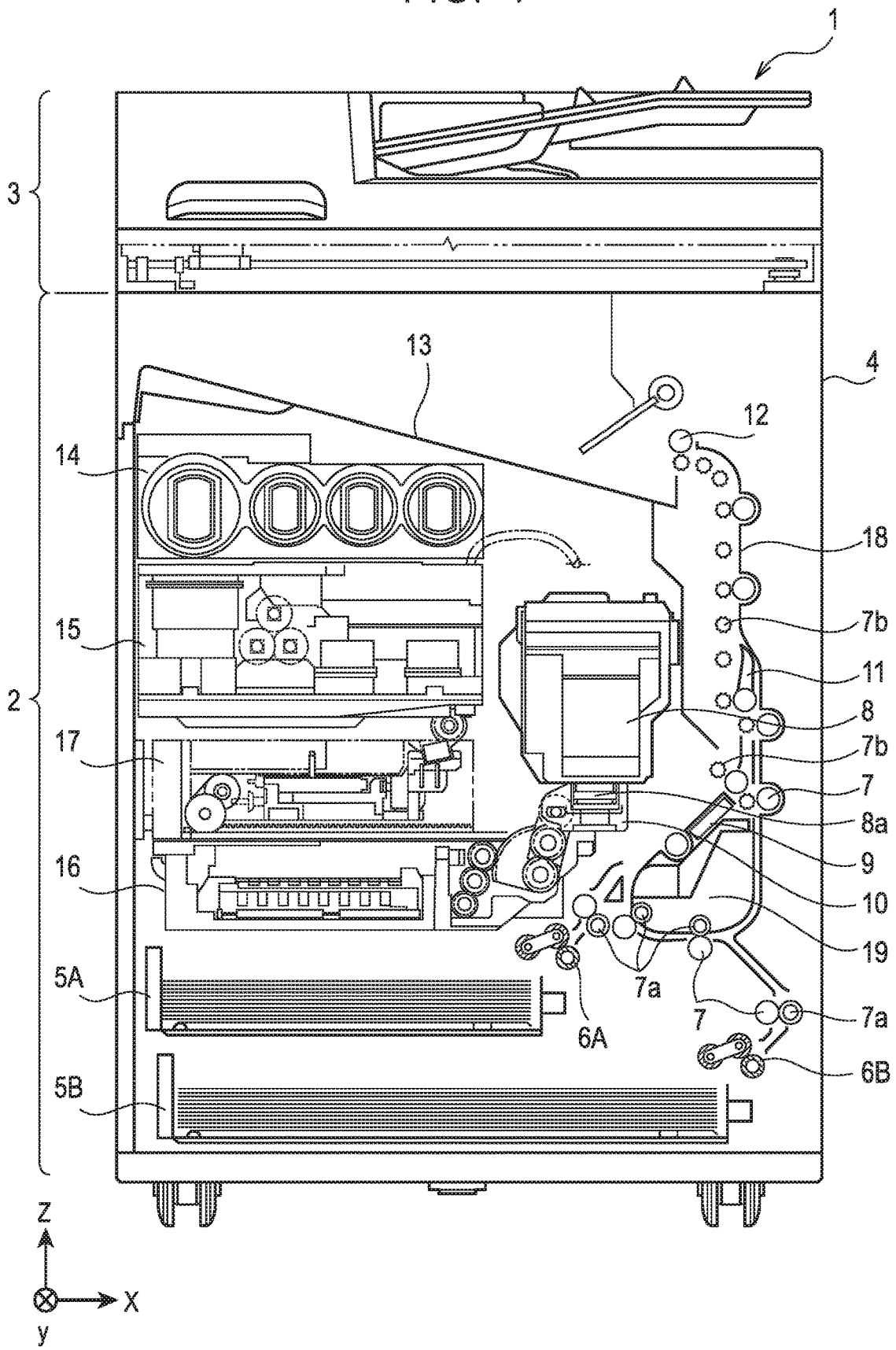
FIG. 1 is a cross-sectional view illustrating an ink jet recording apparatus according to an embodiment of the present invention.

FIG. 1 is a cross-sectional view illustrating an ink jet recording apparatus according to an embodiment of the present invention. In FIG. 1, x represents a horizontal direction, y represents an arrangement direction (depth direction) of ejection orifices of a recording head 8, and z represents a vertical direction. An ink jet recording apparatus 1 of the embodiment illustrated in FIG. 1 is in a so-called standby state where neither a recording operation nor a reading operation is performed.

The ink jet recording apparatus 1 illustrated in FIG. 1 is a composite machine including a recording portion 2 and a scanner portion 3. The ink jet recording apparatus 1 uses the recording portion 2 and the scanner portion 3 separately or in conjunction with each other to perform various processes related to a recording operation and a reading operation. The scanner portion 3 reads (scans) an original document. The ink jet recording apparatus of the present invention may not include a scanner portion.

In the recording portion 2, a first cassette 5A and a second cassette 5B for housing a recording medium having a cut sheet shape are detachably installed at the bottom of a casing 4 in the vertical direction. Relatively small recording mediums of up to A4 size are placed flat and housed in the first cassette 5A. Relatively large recording mediums of up to A3 size are placed flat and housed in the second cassette 5B. A first feeding unit 6A separating and feeding the housed recording mediums one by one is provided near the first cassette 5A. Similarly, a second feeding unit 6B is provided near the second cassette 5B. When the recording operation is performed, the recording mediums are selectively fed from either one of the cassettes.

Conveying rollers 7, a discharging roller 12, pinch rollers 7*a*, spurs 7*b*, a guide 18, an inner guide 19 and a flapper 11 are conveying mechanisms for guiding the recording medium in a predetermined direction. The conveying rollers 7 are drive rollers arranged on the upstream side and the downstream side of the recording head 8 and driven by a conveying motor (not illustrated). The pinch rollers 7*a* are driven rollers rotating together with the conveying rollers 7 while nipping the recording medium. The discharging roller 12 is a drive roller disposed on the downstream side of the conveying roller 7 and driven by the conveying motor (not illustrated). The spurs 7*b* nip and convey the recording medium together with the conveying rollers 7 and the discharging roller 12 disposed on the downstream side of the recording head 8.

The guide 18 is provided in a conveying path of the recording medium to guide the recording medium in a predetermined direction. The inner guide 19 is a member extending the y direction. The inner guide 19 has a curved side surface and guides the recording medium along the side surface thereof. The flapper 11 is a member for changing a direction in which the recording medium is conveyed in a duplex recording operation. A discharging tray 13 is a tray for stacking and holding the recording medium discharged by the discharging roller 12 after being subjected to the recording operation.

The recording head 8 is a full line type recording head. In the recording head 8, a plurality of ejection orifices ejecting ink based on recording data are arranged along the y direction within a range in which a width of the recording medium is covered. When the recording head 8 is in a standby position, an ejection orifice surface 8*a* of the recording head 8 is capped with a cap unit 10 as illustrated in FIG. 1. When the recording operation is performed, the direction of the recording head 8 is changed so that the ejection orifice surface 8*a* faces a platen 9. The platen 9 includes a flat plate extending in the y direction and supports the recording medium from the back when the recording operation is performed by the recording head 8.

An ink tank unit 14 separately stores ink of four colors to be supplied to the recording head 8. An ink supply unit 15 is provided in the midstream of a flow path connecting the ink tank unit 14 and the recording head 8 to adjust a flow rate of the ink supplied to the recording head 8 within a suitable range. A maintenance unit 16 includes the cap unit 10 and a wiping unit 17 as a cleaning unit and activates them at a predetermined timing to perform a maintenance operation for the recording head 8.

An example of a material of the wiper as the cleaning unit may include a material having elasticity, such as, for example, a rubber material formed of a urethane resin (urethane rubber). The wiper as a first cleaning unit preferably has a blade shape. A thickness of the blade-like wiper (blade wiper) is preferably 0.1 mm or more to 1.0 mm or less. In addition, the wiper as a second cleaning unit may have any shape capable of performing suction. The second cleaning unit is preferably a wiper (suction wiper) having a suction port shape. Therefore, it is preferable that the suction wiper has a width in which a plurality of ejection orifice arrays are entirely covered in a direction intersecting a direction in which the plurality of ejection orifice arrays are arranged in a recording element substrate.

When using the ink jet recording apparatus illustrated in FIG. 1, first, the recording medium housed in the first cassette 5A or the second cassette 5B is conveyed in the apparatus and an image is recorded by the recording head 8 in the recording portion 2. The recording medium on which the image is recorded is discharged to the discharging tray 13 in a state where a surface after being subjected to recording (immediately before discharged) faces down in the direction of gravity, that is, an inverted state.

(Aqueous Ink)

The ink used in the ink jet recording method of the present invention is aqueous ink for ink jet containing a pigment as a coloring material. Hereinafter, respective components used in the ink will be described in detail.

[Pigment]

A coloring material contained in the ink is a pigment. A content (% by mass) of the pigment in the ink is preferably 0.5% by mass or more to 15.0% by mass or less and more preferably 1.0% by mass or more to 10.0% by mass or less based on the total mass of the ink.

Specific examples of the pigment may include inorganic pigments such as carbon black and titanium oxide; and organic pigments such as azo, phthalocyanine, quinacridone, isoindolinone, imidazolone, diketopyrrolopyrrole, dioxazine and perinone.

From the viewpoint of a method of dispersing a pigment, a resin-dispersed pigment using a resin as a dispersant or a self-dispersible pigment in which a hydrophilic group is bonded to a particle surface of a pigment can be used as a pigment. In addition, a resin-bonded pigment in which an organic group including a resin is chemically bonded to a particle surface of a pigment or a microcapsule pigment in which a particle surface of a pigment is covered with a resin can be used.

As the resin dispersant for dispersing the pigment in an aqueous medium, it is preferable to use a resin dispersant capable of dispersing a pigment in an aqueous medium by an action of an anionic group. As the resin dispersant, resins to be described later, and among them, a water-soluble resin can be used. A content (% by mass) of the pigment in the ink is preferably 0.3 times or more to 10.0 times or less relative to a content (% by mass) of the resin dispersant in terms of a mass ratio.

A self-dispersible pigment in which an anionic group such as a carboxylic acid group, a sulfonic acid group or a phosphonic acid group is bonded to a particle surface of a pigment directly or through another atomic group (—R—) can be used. The anionic group may be any of an acid-type and a salt-type. In a case where the anionic group is a salt-type, a part or whole of the anionic group may be dissociated. In a case where the anionic group is a salt-type, examples of a cation serving as a counter ion may include an alkali metal cation, ammonium and organic ammonium. Specific examples of another atomic group (—R—) may include a straight chain or branched alkylene group having 1 to 12 carbon atoms; an arylene group such as a phenylene group or a naphthylene group; a carbonyl group; an imino group; an amide group; a sulfonyl group; an ester group; and an ether group. In addition, a group obtained by combining those groups may be used.

[Resin]

A resin can be contained in ink A content (% by mass) of the resin in the ink is preferably 0.1% by mass or more to 20.0% by mass or less and more preferably 0.5% by mass or more to 15.0% by mass or less based on the total mass of the ink.

The resin can be added to the ink as a resin dispersant or its assistance, that is, (i) in order to stabilize a dispersion state of the pigment. In addition, a resin can be added to the ink (ii) in order to improve various properties of the recorded image. Examples of a form of the resin may include a block copolymer, a random copolymer, a graft copolymer and combinations thereof. In addition, the resin may be a water-soluble resin dissolved in an aqueous medium and may be a resin particle dispersed in an aqueous medium. The resin particle does not need to contain a coloring material.

In the present specification, the expression "a resin is water-soluble" means that when the resin is neutralized with alkali equivalent to an acid value, the resin is present in an aqueous medium in a state where a particle of which diameter can be measured by a dynamic light scattering method is not formed. It can be determined whether or not the resin is water-soluble by the following method. First, a liquid (resin solid content: 10% by mass), which contains the resin neutralized with the alkali (sodium hydroxide, potassium hydroxide or the like) equivalent to the acid value, is prepared. Next, the prepared liquid is diluted with pure water by 10 times (volume basis) to prepare a sample solution. When the particle diameter of the resin in the sample solution is measured by the dynamic light scattering method or when a particle having a particle diameter is not measured, it can be determined that the resin is water-soluble. The measurement conditions can be set as follows.

[Measurement Condition]

SetZero: 30 seconds

Number of measurements: 3 times

Measurement time: 180 seconds

As a particle size distribution analyzer, a particle size analyzer (for example, trade name "UPA-EX150" manufactured by Nikkiso Co., Ltd.) or the like by the dynamic light scattering method can be used. It goes without saying that the particle size distribution analyzer to be used, the measurement conditions and the like are not limited thereto.

The acid value of the water-soluble resin is preferably 100 mgKOH/g or more to 250 mgKOH/g or less. The acid value of the resin constituting the resin particle is preferably 5 mgKOH/g or more to 100 mgKOH/g or less. A weight average molecular weight of the water-soluble resin is preferably 3,000 or more to 15,000 or less. A weight average molecular weight of the resin constituting the resin particle is preferably 1,000 or more to 2,000,000 or less. A volume average particle diameter of the resin particle measured by the dynamic light scattering method is preferably 50 nm or more to 500 nm or less.

Examples of the resin may include an acrylic resin, a urethane-based resin and an olefin-based resin. Among them, an acrylic resin and a urethane-based resin are preferable, and an acrylic resin constituted by a unit derived from (meth)acrylic acid or (meth)acrylate is further preferable.

As the acrylic resin, a resin having a hydrophilic unit and a hydrophobic unit as a constitution unit is preferable.

The hydrophilic unit is a unit having a hydrophilic group such as an anionic group. For example, the hydrophilic unit can be formed by polymerizing a hydrophilic monomer having a hydrophilic group. Specific examples of the hydrophilic monomer having a hydrophilic group may include acid monomers having a carboxylic acid group such as (meth)acrylic acid, itaconic acid, maleic acid and fumaric acid, and anionic monomers such as anhydrides and salts of these acid monomers. Examples of the cation constituting the salt of the acid monomer may include ions such as lithium, sodium, potassium, ammonium and organic ammonium. The hydrophobic unit is a unit having no hydrophilic group such as an anionic group. For example, the hydrophobic unit can be formed by polymerizing a hydrophobic monomer having no hydrophilic group such as an anionic group. Specific examples of the hydrophobic monomer may include monomers having an aromatic ring such as styrene, α-methylstyrene and benzyl (meth)acrylate; and (meth) acrylic acid ester monomers such as methyl (meth)acrylate, butyl (meth)acrylate and 2-ethylhexyl (meth)acrylate.

Among them, an acrylic resin having a hydrophilic unit derived from (meth)acrylic acid and a hydrophobic unit derived from at least one of a monomer having an aromatic ring and a (meth)acrylic acid ester monomer is preferable. In particular, an acrylic resin having a hydrophilic unit derived from (meth)acrylic acid and a hydrophobic unit derived from at least one monomer of styrene and α-methylstyrene is preferable. Since these acrylic resins easily interact with the pigment, the acrylic resins can be suitably used as a resin dispersant for dispersing the pigment.

The urethane-based resin can be obtained, for example, by reacting polyisocyanate with polyol. In addition, the urethane-based resin can be obtained by the additional reaction of a chain extender. Examples of the olefin-based resin may include polyethylene and polypropylene.

[Aqueous Medium]

The ink used in the ink jet recording method of the present invention is aqueous ink containing water as an aqueous medium. The ink can contain water or an aqueous medium which is a mixed solvent of water and a water-soluble organic solvent. It is preferable to use deionized water or ion-exchanged water as the water. A content (% by mass) of the water in the aqueous ink is preferably 50.0% by mass or more to 95.0% by mass or less based on the total mass of the ink. In addition, the content (% by mass) of the water-soluble organic solvent in the aqueous ink is preferably 3.0% by mass or more to 50.0% by mass or less based on the total mass of the ink. As the water-soluble organic solvent, any of water-soluble organic solvent capable of being used in ink for ink jet, such as alcohols, (poly)alkylene glycols, glycol ethers, nitrogen-containing compounds and sulfur-containing compounds can be used.

[Other Additives]

The ink may contain various additives such as an anti-foaming agent, a surfactant, a pH adjuster, a viscosity modifier, a rust preventive, a preservative, a mildew-proofing agent, an antioxidant and an anti-reducing agent, as necessary, in addition to the above-mentioned components.

[Physical Property of Ink]

Ink used in the ink jet recording method of the present invention includes the first ink ejected from the first ejection orifice array and the second ink ejected from the second ejection orifice array. In addition, the dynamic surface tension ($\gamma_{D1}$) of the first ink is the static surface tension ($\gamma_{S2}$) of the second ink or more. When a difference between the dynamic surface tension ($\gamma_{D1}$) of the first ink and the static surface tension ($\gamma_{S2}$) of the second ink is small, it is difficult for the first ink to flow into the ejection orifice, such that deterioration of the quality of the image can be further suppressed, which is preferable. Specifically, the difference between the dynamic surface tension ($\gamma_{D1}$) of the first ink and the static surface tension ($\gamma_{S2}$) of the second ink is preferably 20 mN/m or less and more preferably 10 mN/m or less. In addition, the difference between the dynamic surface tension ($\gamma_{D1}$) of the first ink and the static surface tension ($\gamma_{S2}$) of the second ink is preferably 0 mN/m or more, more preferably 3 mN/m or more, and still more preferably 5 mN/m or more.

A dynamic surface tension of ink is preferably 25 mN/m or more to 50 mN/m or less. In addition, a static surface tension of ink is preferably 25 mN/m or more to 45 mN/m or less. In particular, when a static surface tension of ($\gamma_{S1}$) of the first ink is high, wettability to the wiper is reduced, such that it is difficult for the first ink to be drawn from the ejection orifice, which is preferable. Specifically, the static surface tension of ($\gamma_{S1}$) of the first ink is preferably 25 mN/m or more and more preferably 30 mN/m or more, but is preferably 50 mN/m or less.

The dynamic surface tension used to specify the properties of ink is a dynamic surface tension at a lifetime of 10 milliseconds determined by a maximum bubble pressure method. The maximum bubble pressure method is a method in which the maximum pressure required to release bubble formed at the tip of a probe (capillary tube) immersed in a liquid to be measured is measured and the surface tension of the liquid is calculated from the maximum pressure. The maximum pressure is measured while bubble is continuously formed at the tip of the probe. The time from when a surface of a new bubble is formed at the tip of the probe to when the maximum bubble pressure (the point of time when the radius of curvature of the bubble is equal to a radius of the tip portion of the probe) is reached is referred to as a "lifetime". In addition, the static surface tension used for specifying characteristics of ink is a physical property value determined by a plate method.

A surface tension of ink can be adjusted by the type and content of a surfactant, a water-soluble organic solvent, a resin or the like. The dynamic surface tension is a surface tension of a liquid in a moving state. Therefore, for adjusting the dynamic surface tension of ink, it is preferable to use a component capable of controlling a surface tension even in a moving state.

The hues of first ink and the second ink may be the same or different from each other. In the present invention, the expression "different hues" means that the first ink and the second ink are classified into different hues within the range of hues classified into, for example, black and colors. Examples of the hue of color include cyan, magenta, yellow, red, green and blue. In a case where the first ink and the second ink have different hues, it is preferable that the lightness of the second ink is equal to or less than that of the first ink in consideration of the influence of a color change by color mixing. A sample obtained by diluting the ink with water to an appropriate factor and adjusting the absorbance value to an appropriate degree for measurement is measured by using a spectroscopic photometer, whereby the lightness of ink can be measured. When comparing the lightnesses between the first ink and the second ink, the first ink and the second ink are diluted to the same factor. In general, the order of lightness levels of basic colors in the aqueous ink used in the ink jet recording method is sequentially black, cyan, magenta and yellow.

EXAMPLES

Hereinafter, the present invention will be described in more detail by way of examples, comparative examples, and reference examples. The present invention is not limited to the following examples as long as it is within the scope of the present invention. With respect to the amount of component, "part(s)" and "%" are on a mass basis, unless otherwise specified.

<Preparation of Pigment Dispersion Liquid>

(Pigment Dispersion Liquid 1)

A solution prepared by dissolving 5.0 g of concentrated hydrochloric acid in 5.5 g of water was cooled to 5° C. and 1.6 g of 4-aminophthalic acid was added to the solution in this state. A container containing this solution was placed in an ice bath and the solution was stirred while keeping the temperature of the solution at 10° C. or lower, and a solution prepared by dissolving 1.8 g of sodium nitrite in 9.0 g of ion-exchanged water of 5° C. was added to the solution. After stirring for 15 minutes, 6.0 g of a pigment (specific surface area of 220 $m^2/g$, dibutyl phthalate (DBP) oil absorption of 105 mL/100 g) was added under stirring, and then stirring was performed for additional 15 minutes to obtain slurry. The resulting slurry was filtered with a filter paper (trade name "Standard Filter Paper No. 2", manufactured by Advantec Co., Ltd.), the particles were sufficiently washed with water and dried in an oven at 110° C. Sodium ions serving as counter ions were replaced with potassium ions by an ion exchange method, and then an appropriate amount of ion-exchanged water was added to adjust a content of the pigment, thereby obtaining a pigment dispersion liquid 1 (a content of a pigment was 20.0%). The pigment dispersion liquid 1 was used to adjust ink having a black hue.

(Pigment Dispersion Liquid 2)

A styrene-ethyl acrylate-acrylic acid copolymer (resin dispersant) having an acid value of 150 mgKOH/g and a weight average molecular weight of 8,000 was prepared. The prepared resin dispersant is neutralized with potassium hydroxide equimolar to the acid value of the prepared resin dispersant and dissolved in ion-exchanged water, thereby preparing an aqueous solution of a resin dispersant (a content of a resin (solid content) was 20.0%). 20.0 parts of a pigment (C.I. Pigment Blue 15:3), 30.0 parts of an aqueous solution of a resin dispersant, and 50.0 parts of ion-exchanged water were mixed to obtain a mixture. The resulting mixture and 200 parts of zirconia beads having a diameter of 0.3 mm were placed into a batch-type vertical sand mill (manufactured by AIMEX CO., Ltd.) and dispersed for 5 hours while being cooled with water and then a centrifugal treatment was performed to remove coarse particles. The mixture was subjected to pressure filtration with a microfilter (manufactured by FUJIFILM Corporation) having a pore size of 3.0 μm and then an appropriate amount of ion-exchanged water was added to the mixture, thereby obtaining a pigment dispersion liquid 2. The content of the pigment in the resulting pigment dispersion liquid 2 was 20.0% and the content of the resin dispersant was 6.0%. The pigment dispersion liquid 2 was used to adjust ink having a cyan hue.

(Pigment Dispersion Liquid 3)

A pigment dispersion liquid 3 (a content of a pigment was 20.0% and a content of a resin dispersant was 6.0%) was obtained by the same procedure as that of the pigment dispersion liquid 2 described above except that the pigment was changed to C.I. Pigment Yellow 74. The pigment dispersion liquid 3 was used to adjust ink having a yellow hue.

(Pigment Dispersion Liquid 4)

A pigment dispersion liquid 4 (a content of a pigment was 20.0% and a content of a resin dispersant was 4.0%) was obtained by the same procedure as that of the pigment dispersion liquid 2 described above except for using 20.0 parts of a pigment (C.I. Pigment Yellow 74), 20.0 parts of an aqueous solution of a resin dispersant and 60.0 parts of ion-changed water. The pigment dispersion liquid 4 was used to adjust ink having a yellow hue.

<Preparation of Liquid Including Resin>

(Resin 1)

20.0 parts of a resin 1 (styrene-ethyl acrylate-acrylic acid copolymer having an acid value of 120 mgKOH/g and a weight average molecular weight of 7,200) which is an aqueous acrylic resin was prepared. The resin 1 was neutralized with potassium hydroxide equimolar to the acid value of the resin 1 and an appropriate amount of ion-exchanged water was added thereto, thereby obtaining a liquid including the resin 1 (a content of a resin (solid content) was 20.0%).

(Resin 2)

After dissolving polypropylene glycol having a number average molecular weight of 2,000 in methyl ethyl ketone, isophorone diisocyanate and dimethylol propionic acid were added thereto, and then the reaction was performed at 75° C. for 1 hour, thereby obtaining a prepolymer solution. The resulting prepolymer solution was cooled up to 60° C. and an aqueous potassium hydroxide solution was added to neutralize the acid group. Thereafter, cooling was performed to 40° C., ion-exchanged water was added, and high-speed stirring was performed with a homomixer to emulsify the solution. A chain extension agent was added and a chain extension reaction was performed at 30° C. for 12 hours. After performing analysis by using a Fourier-transform infrared spectroscopy (FT-IR), at a portion where the presence of an isocyanate group was not detected, methyl ethyl ketone was removed by distillation by heating and decompressing the prepolymer solution. As a result, a resin 2 having an acid value of 70 mgKOH/g and a weight average molecular weight of 27,000, which is an aqueous urethane resin, was obtained. An appropriate amount of ion-exchanged water was added, thereby obtaining a liquid including the resin 2 (a content of a resin (solid content) was 20.0%).

<Analysis Method for Resin>

An acid value of a resin was measured by potentiometric titration as described below. An acid value of a resin prepared by dissolving tetrahydrofuran was measured by colloid titration using a potential difference with an automatic potentiometric titrator (AT-510, manufactured by KYOTO ELECTRONICS MANUFACTURING CO., LTD.) equipped with a flow potential titration unit (PCD-500). An ethanol solution of potassium hydroxide was used as a titrant.

A weight average molecular weight of a resin was measured by gel permeation chromatography (GPC) as described below. A resin was dissolved in tetrahydrofuran at 25° C. for 24 hours to obtain a solution. The resulting solution was filtered with a membrane filter to obtain a sample solution. The sample solution was adjusted so that a concentration of a component soluble in tetrahydrofuran becomes about 0.3%.

A weight average molecular weight of the sample solution was measured by using a GPC measurement device including an RI detector (trade name "2414 detector", manufactured by Waters) under the following conditions. As the GPC measurement device, trade name "Waters 2695 Separations Module" (manufactured by Waters) was used. A four-gang column of KF-806M (manufactured by SHOWA DENKO K.K.) was used as a column, tetrahydrofuran was used as an eluent, a flow velocity was 1.0 mL/min, an oven temperature was 40° C. and a sample injection amount was 100 μL. In the calculation of the weight average molecular weight of the resin, a molecular weight calibration curve prepared using a standard polystyrene resin was used. As the standard polystyrene resin, TSK standard polystyrene resins such as F-850, F-450, F-288, F-128, F-80, F-40, F-20, F-10, F-4, F-2, F-1, A-5000, A-2500, A-1000 and A-500 (trade names, manufactured by Tosoh Corporation) were used.

<Preparation of Ink>

Respective components (unit: %) given on the top part of Table 1 were mixed and sufficiently stirred, and then the mixture was subjected to pressure filtration with a cellulose acetate filter (manufactured by Advantec Co., Ltd.) having a pore size of 0.8 Inn, thereby preparing the respective ink. In Table 1, "Acetylenol E100" and "Acetylenol E60" represent a trade name of a surfactant manufactured by Kawaken Fine Chemicals Co., Ltd. The lower part of Table 1 shows a content (%) of a pigment, a content (%) of a resin, a dynamic surface tension ($\gamma_D$) at a lifetime of 10 milliseconds and a static surface tension ($\gamma_S$). The dynamic surface tension $\gamma_D$ was measured at 25° C. by using a dynamic surface tensiometer (trade name "BUBBLE PRESSURE TENSIOMETER BP-2", manufactured by KRUSS GmbH) by the maximum bubble pressure method. The static surface tension $\gamma_s$ was measured at 25° C. by using an automatic surface tensiometer (trade name "DY-300", manufactured by Kyowa Interface Science, Inc.).

TABLE 1

Composition and properties of ink

| | Ink | | | | | | |
|---|---|---|---|---|---|---|---|
| | 1 | 2 | 3 | 4 | 5 | 6 | 7 |
| Pigment dispersion liquid 1 | 35.0 | | | | 35.0 | 35.0 | 35.0 |
| Pigment dispersion liquid 2 | | 30.0 | | | | | |
| Pigment dispersion liquid 3 | | | 30.0 | | | | |
| Pigment dispersion liquid 4 | | | | 30.0 | | | |
| Liquid including resin 1 | | | | | | | 5.0 |
| Liquid including resin 2 | 5.0 | | | | | | 5.0 |
| Glycerin | 12.0 | 12.0 | 12.0 | 12.0 | | 4.0 | 12.0 |
| Trimethylolpropane | 10.0 | 10.0 | 10.0 | 10.0 | 10.0 | 10.0 | |
| 1,2-Hexanediol | 1.0 | 3.0 | 1.0 | 4.0 | 1.0 | 1.0 | 1.0 |

TABLE 1-continued

| Composition and properties of ink | | | | | | | |
|---|---|---|---|---|---|---|---|
| | Ink | | | | | | |
| | 1 | 2 | 3 | 4 | 5 | 6 | 7 |
| 1-Pentanol | | | | | 12.0 | 8.0 | 12.0 |
| Acetylenol E100 | | | | | 1.0 | 0.7 | |
| Acetylenol E60 | 0.5 | 0.5 | 0.9 | 0.5 | 0.1 | 0.1 | 0.5 |
| Ion-exchanged water | 36.6 | 44.5 | 46.2 | 43.6 | 40.9 | 41.2 | 29.6 |
| Content (%) of pigment | 7.0 | 6.0 | 6.0 | 6.0 | 7.0 | 7.0 | 7.0 |
| Content (%) of resin | 1.0 | 1.8 | 1.8 | 1.2 | 0.0 | 0.0 | 2.0 |
| Dynamic surface tension $\gamma_D$ (mN/m) | 41 | 40 | 40 | 39 | 38 | 40 | 29 |
| Static surface tension $\gamma_S$ (mN/m) | 33 | 34 | 33 | 33 | 21 | 25 | 26 |

<Configuration of Recording Head>

Recording heads 1 and 2 of a type in which thermal energy is applied to eject ink were prepared. In the recording element substrate constituting these recording heads, two rows of the ejection orifice arrays (first ejection orifice array and second ejection orifice array) configured by arranging 512 ejection orifices are arranged at an array density of 600 dpi. The mass of ink droplets ejected from one ejection orifice is 4 ng. The upstream side of the wiping direction is the first ejection orifice array and the downstream side of the wiping direction is the second ejection orifice array.

(Recording Head 1)

Figure 3:
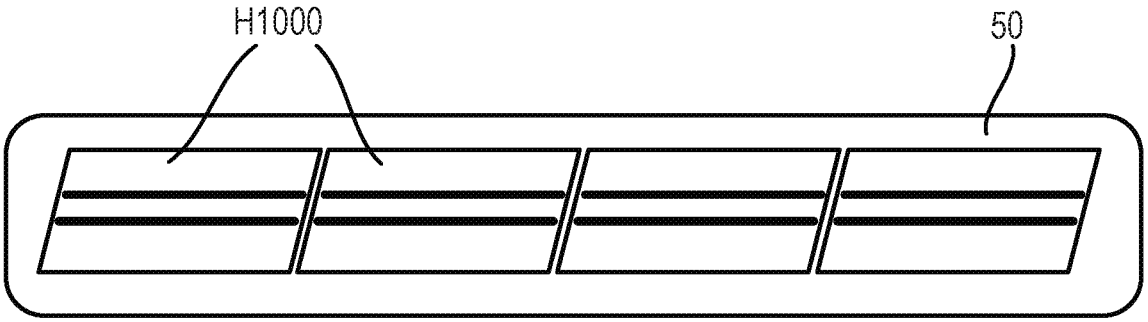
FIG. 3 is a schematic view illustrating an example of a line head in which recording element substrates are arranged in line with each other.

As illustrated in FIG. 3, the recording head 1 is a line head 50 in which the plurality of recording element substrates H1000 are arranged in line with each other so that ends of the adjacent recording element substrates H1000 overlap each other in an arrangement direction of the ejection orifice to form a joint portion.

(Recording Head 2)

Figure 4:
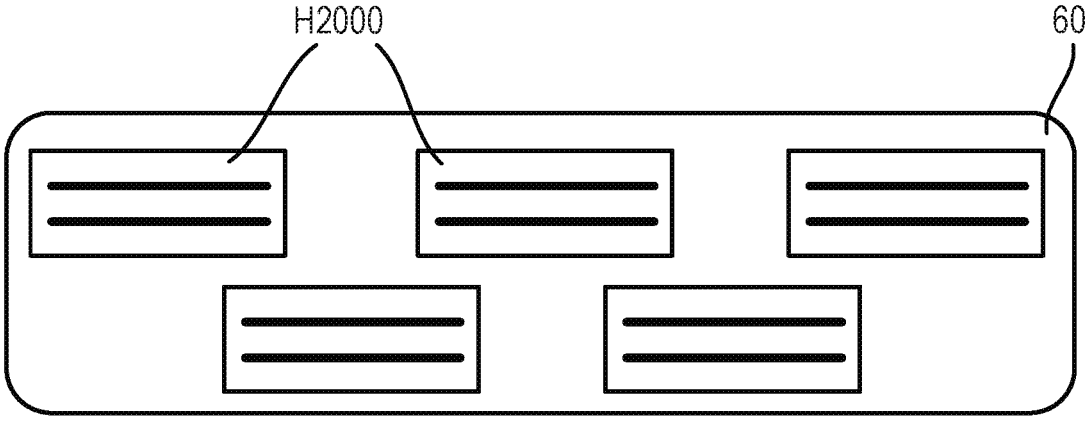
FIG. 4 is a schematic view illustrating an example of a line head in which recording element substrates are arranged in zigzag.

As illustrated in FIG. 4, the recording head 2 is a line head 60 in which the plurality of recording element substrates H2000 are arranged in zigzag so that ends of the adjacent recording element substrates H2000 overlap each other in an arrangement direction of the ejection orifice to form a joint portion.

<Cleaning Condition>

Figure 5:
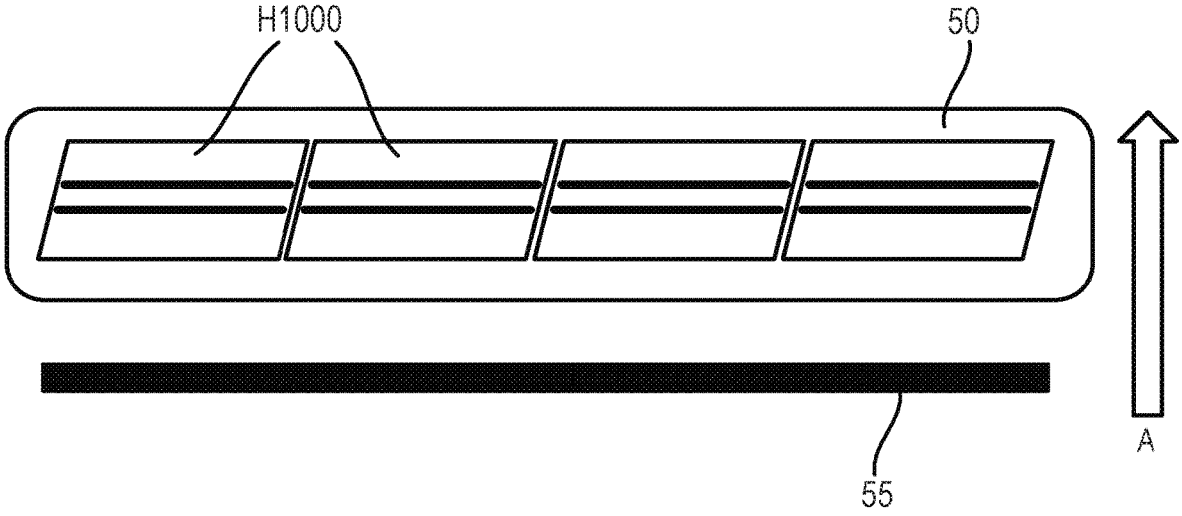
FIG. 5 is a schematic view illustrating a shape and an arrangement state of a wiper used with Condition 7.

Cleaning conditions (Conditions 1 to 7) are shown in Table 2. In the first cleaning unit in Table 2, "a length D (mm) of a wiper overlapping portion" means a length of the overlapping portion (wiper overlapping portion 23) of an end of the first wiper 20 and an end of the second wiper 21, as illustrated in FIG. 2. In the first cleaning unit in Table 2, "a distance S (mm) between wipers" means a distance between the first wiper 20 arranged in the front side of a wiping direction A and the second wiper 21 arranged in the rear side of the wiping direction A, as illustrated FIG. 2. In the second cleaning unit in Table 2, as "a wiper unit including a suction nozzle", a wiper unit including a suction nozzle configured as illustrated in FIG. 9 of Japanese Patent Application Laid-Open No. 2012-166374 and sucking and cleaning the ejection orifice surface. The suction wiper constituting the wiper unit has a width in which ejection orifice arrays of the first ink and the second ink are collectively covered in a direction intersecting a direction in which a plurality of ejection orifice arrays are arranged in the recording element substrate. FIG. 5 is a schematic view illustrating a shape and an arrangement state of a wiper used with Condition 7. In Condition 7, as illustrated in FIG. 5, the blade wiper 55 was used.

TABLE 2

| Cleaning condition | | | | | | | | |
|---|---|---|---|---|---|---|---|---|
| | | Condition | | | | | | |
| | | 1 | 2 | 3 | 4 | 5 | 6 | 7 |
| First cleaning unit | Configuration | Blade wiper | Blade wiper | Blade wiper | Blade wiper | Blade wiper | Blade wiper | Blade wiper |
| | Material | Urethane resin | Urethane resin | Urethane resin | Urethane resin | Urethane resin | Urethane resin | Urethane resin |
| | Thickness (mm) | 0.5 | 0.5 | 0.5 | 0.5 | 0.5 | 0.5 | 0.5 |
| | Arrangement | Inline | Zigzag | Inline | Zigzag | Inline | Parallel | One (FIG. 5) |
| | Length D (mm) of wiper overlapping portion | 3.0 | 3.0 | 3.0 | 3.0 | 3.0 | 0.0 | — |
| | Distance S (mm) between wipers | 8.0 | 8.0 | 8.0 | 8.0 | 8.0 | 8.0 | — |
| | Wiping of joint portion by wiper overlapping portion | Performed | Performed | Performed | Performed | Not performed | Not performed | — |
| | Wiping speed (mm/s) | 80 | 80 | 80 | 80 | 80 | 80 | 80 |

TABLE 2-continued

| Cleaning condition | | | | | | | | |
|---|---|---|---|---|---|---|---|---|
| | | Condition | | | | | | |
| | | 1 | 2 | 3 | 4 | 5 | 6 | 7 |
| Second cleaning unit | Configuration | Wiper unit including suction nozzle | Wiper unit including suction nozzle | None | None | Wiper unit including suction nozzle | None | None |
| | Wiping speed (mm/s) | 10 | 10 | — | — | 10 | — | — |

<Evaluation>

(Ink Jet Recording Apparatus)

The ink jet recording apparatus prepared according to the evaluation conditions shown in Table 3 was used, and then wiping was performed 500 times to evaluate the quality of the recorded image. A recording duty is defined as 100% when an image is recorded under the condition in which four ink droplets of 4 ng per one droplet are applied to a unit region of 1/600 inch×1/600 inch. In the evaluation criteria shown below, "A" and "B" mean an acceptable level and "C" and "D" mean an unacceptable level. The evaluation results are shown in Table 3.

(Density Unevenness)

The ejection orifice surface was wiped 500 times at a temperature of 15° C. and a relative humidity of 10%. Thereafter, a solid image having a recording duty of 100% and 18 cm in a longitudinal direction of the recording head (line head) and 2 cm in a sheet feeding direction was recorded on a recording medium (trade name "high grade exclusive paper HR-101S" (manufactured by Cannon INC.)). On the recorded solid image, optical densities of 10 locations corresponding to the joint portions and 10 locations corresponding to the non-joint portions were measured using a reflective densitometer (trade name "Macbeth RD-918", manufactured by Macbeth). An average value X of the optical densities of the "10 locations corresponding to the joint portions" and an average value Y of optical densities of the "10 locations corresponding to the non-joint portions" were calculated, and the density unevenness was evaluated from a value of a ratio (Y/X) of these average values according to the following evaluation criteria.

A: Y/X was 0.95 or more to 1.05 or less.

B: Y/X was 0.90 or more to less than 0.95 or more than 1.05 to 1.10 or less.

C: Y/X was 0.80 or more to less than 0.90 or more than 1.10 to 1.20 or less.

D: Y/X was less than 0.80 or more than 1.20.

(Irregular Ejection)

After wiping the ejection orifice surface 500 times at a temperature of 30° C. and a relative humidity of 10%, patterns (nozzle check patterns) for checking the ejection state from each ejection orifice were recorded on a recording medium (trade name "high resolution paper HR-101S" (manufactured by Cannon Inc.)). A displacement of the dot formation positions (irregularity) in the recorded nozzle check patterns was observed and the irregular ejection was evaluated according to the following evaluation criteria.

A: There was no ejection orifice at which the irregular ejection occurred.

B: The irregular ejection occurred at more than 0% to 5% or less of the ejection orifices.

C: The irregular ejection occurred at more than 5% of the ejection orifices.

TABLE 3

| Evaluation condition and evaluation result | | | | | | | |
|---|---|---|---|---|---|---|---|
| | | Evaluation condition | | | | Evaluation result | |
| | | Recording head | Cleaning condition | First ink | Second ink | Density unevenness | Irregular ejection |
| Example | 1 | 1 | 1 | 1 | 1 | A | A |
| | 2 | 1 | 1 | 2 | 2 | A | A |
| | 3 | 1 | 1 | 3 | 3 | A | A |
| | 4 | 1 | 1 | 4 | 4 | A | A |
| | 5 | 1 | 1 | 4 | 1 | A | A |
| | 6 | 1 | 1 | 3 | 2 | A | A |
| | 7 | 1 | 1 | 5 | 5 | B | A |
| | 8 | 1 | 1 | 6 | 1 | A | A |
| | 9 | 2 | 2 | 1 | 1 | A | A |
| | 10 | 1 | 3 | 1 | 1 | A | B |
| | 11 | 1 | 1 | 1 | 4 | B | A |
| | 12 | 2 | 4 | 5 | 5 | B | B |
| Comparative Example | 1 | 1 | 1 | 7 | 1 | D | B |
| | 2 | 2 | 2 | 7 | 1 | C | B |
| | 3 | 1 | 5 | 1 | 1 | A | C |
| | 4 | 1 | 5 | 7 | 1 | A | C |
| | 5 | 1 | 6 | 1 | 1 | A | C |
| | 6 | 1 | 7 | 1 | 1 | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189021, filed Oct. 4, 2018, which is hereby incorporated by reference herein in its entirety.

What is claimed is:

1. A method of forming an image on a recording medium using an ink jet recording apparatus, the ink jet recording apparatus including a recording head having a plurality of recording element substrates arranged in an arrangement direction so that ends of the adjacent recording element substrates overlap each other in the arrangement direction to form joint portions, each recording element substrate including a plurality of ejection orifice arrays, the method comprising:

ejecting a first ink from ejection orifices of a first ejection orifice array, the first ejection orifice array being one of the plurality of ejection orifice arrays of each recording element substrate, the ejection orifices of the first ejection orifice array being arranged in the arrangement direction and formed on an ejection orifice surface of each recording element substrate;

ejecting a second ink from ejection orifices of a second ejection orifice array, the second ejection orifice array being one of the plurality of ejection orifice arrays of each recording element substrate, the ejection orifices of the second ejection orifice array being arranged in the arrangement direction and formed on the ejection orifice surface of each recording element substrate; and wiping the ejection orifice surfaces of the plurality of recording element substrates with a plurality of blade wipers arranged in the arrangement direction so that ends of the adjacent wipers overlap each other in the arrangement direction to form wiper overlapping portions, the plurality of wipers being brought into contact with the ejection orifice surfaces in a direction intersecting the arrangement direction of the recording element substrates to first wipe the first ejection orifice array and then wipe the second ejection orifice array, at least a part of the wiper overlapping portion wiping the joint portion, wherein a dynamic surface tension ($\gamma_{D1}$) of the first ink is equal to or more than a static surface tension ($\gamma_{S2}$) of the second ink.

2. The ink jet recording method according to claim 1, wherein a static surface tension ($\gamma_{S1}$) of the first ink is 25 mN/m or more.

3. The ink jet recording method according to claim 1, wherein the recording head is a line head in which each of the plurality of recording element substrates are arranged in line with each other.

4. The ink jet recording method according to claim 1, wherein a first cleaning unit includes the plurality of blade wipers, and the method further comprises cleaning the ejection orifice surfaces with a second cleaning unit that includes a suction nozzle to suck the ejection orifice surfaces.

5. The ink jet recording method according to claim 1, wherein a lightness of the second ink is a lightness of the first ink or less.

6. The ink jet recording method according to claim 1, wherein the plurality of blade wipers comprises a material having elasticity.

7. The ink jet recording method according to claim 1, wherein a difference between the dynamic surface tension ($\gamma_{D1}$) of the first ink and the static surface tension ($\gamma_{S2}$) of the second ink is 20 mN/m or less.

8. The ink jet recording method according to claim 1, wherein a difference between the dynamic surface tension ($\gamma_{D1}$) of the first ink and the static surface tension ($\gamma_{S2}$) of the second ink is 10 mN/m or less.

9. The ink jet recording method according to claim 1, wherein a difference between the dynamic surface tension ($\gamma_{D1}$) of the first ink and the static surface tension ($\gamma_{S2}$) of the second ink is 0 mN/m or more.

10. The ink jet recording method according to claim 1, wherein a difference between the dynamic surface tension ($\gamma_{D1}$) of the first ink and the static surface tension ($\gamma_{S2}$) of the second ink is 3 mN/m or more.

11. The ink jet recording method according to claim 1, wherein a difference between the dynamic surface tension ($\gamma_{D1}$) of the first ink and the static surface tension ($\gamma_{S2}$) of the second ink is 5 mN/m or more.

12. The ink jet recording method according to claim 1, wherein a static surface tension ($\gamma_{S1}$) of the first ink is 50 mN/m or less.

13. The ink jet recording method according to claim 1, wherein a static surface tension ($\gamma_{S2}$) of the second ink is 25 mN/m or more to 45 mN/m or less.

14. The ink jet recording method according to claim 1, wherein a dynamic surface tension of the first ink ($\gamma_{D1}$) is 25 mN/m or more to 50 mN/m or less.

15. The ink jet recording method according to claim 1, wherein a dynamic surface tension of the second ink ($\gamma_{D2}$) is 25 mN/m or more to 50 mN/m or less.

16. An ink jet recording apparatus comprising:

a recording head including a plurality of recording element substrates arranged in an arrangement direction so that ends of the adjacent recording element substrates overlap each other in the arrangement direction to form joint portions, each recording element substrate including a first ejection orifice array and a second ejection orifice array, each of the first ejection orifice array and the second ejection orifice array having a plurality of ejection orifices configured to eject aqueous ink containing a pigment, the ejection orifices of the first ejection orifice array and the second ejection orifice array being arranged in the arrangement direction and formed on an ejection orifice surface of each recording element substrate, the first ejection orifice array being configured to eject a first ink and the second ejection orifice array being configured to eject a second ink, wherein a dynamic surface tension ($\gamma_{D1}$) of the first ink is equal to or more than a static surface tension ($\gamma_{S2}$) of the second ink; and a cleaning unit including a plurality of blade wipers arranged in the predetermined direction so that ends of the adjacent wipers overlap each other in the arrangement direction to form wiper overlapping portions, the cleaning unit being configured to wipe the ejection orifice surface of each recording element substrate by bringing the plurality of wipers in contact with the ejection orifice surfaces in a direction intersecting the arrangement direction of the recording element substrates to first wipe the first ejection orifice array and then wipe second ejection orifice array and at least a part of the wiper overlapping portion wiping the joint portion.

17. The ink jet recording apparatus according to claim 16, further comprising an ink tank containing the first ink and an ink tank containing the second ink.

* * * * *